US005344244A

United States Patent [19]

Fukahori et al.

[11] Patent Number: 5,344,244

[45] Date of Patent: Sep. 6, 1994

[54] PRINTER AND INK RIBBON CARTRIDGE HAVING COLOR BLOCK DETECTION MEANS

[75] Inventors: Kenichi Fukahori, Kanagawa; Shin Iima, Tokyo; Shuji Sato; Masaki Shimoha; Hideki Ito; Mutsuko Narita, all of Kanagawa, Japan

[73] Assignee: Sony Corporation, Japan

[21] Appl. No.: 940,393

[22] Filed: Sep. 3, 1992

[30] Foreign Application Priority Data

Sep. 11, 1991 [JP] Japan ..... 3-230679

[51] Int. Cl.[5] ..... B41J 33/14

[52] U.S. Cl. ..... 400/249; 400/219; 400/240.3

[58] Field of Search ..... 400/240, 240.3, 249, 400/239, 219, 244, 247

[56] References Cited

U.S. PATENT DOCUMENTS 4,745,415 5/1988 Konda et al. ..... 346/105
4,975,715 12/1990 Saito et al. ..... 346/1.1

FOREIGN PATENT DOCUMENTS 0041579 2/1986 Japan ..... 400/249
0030041 2/1987 Japan ..... 400/249
0189174 8/1987 Japan ..... 400/249
0291978 11/1989 Japan ..... 400/249
0009869 1/1991 Japan ..... 400/249
0016773 1/1991 Japan ..... 400/249

OTHER PUBLICATIONS

European Search Report Patent Abstracts of Japan, vol. 9, No. 245.

*Primary Examiner*—Edgar S. Burr
*Assistant Examiner*—John S. Hilten
*Attorney, Agent, or Firm*—Ronald P. Kananen

[57] ABSTRACT

A video printing apparatus including a thermal head and accommodating an ink ribbon cartridge having a plurality of color blocks. The apparatus has a subsidiary head which records an identification mark on the color blocks when used in a printing operation. The identification mark is recorded on a predetermined portion of the color block which is not used in a printing operation. A sensor is provided for detecting the identification mark recorded on the used color blocks.

7 Claims, 4 Drawing Sheets

FIG. 6

21

| | | | | |
|---|---|---|---|---|
| (1) | ○ | ○ | ⊘ | USED, 1ST~9TH |
| (2) | ○ | ⊘ | ○ | USED, 10TH |
| (3) | ○ | ⊘ | ⊘ | USED, 20TH |
| (4) | ⊘ | ○ | ○ | USED, 30TH |
| (5) | ⊘ | ○ | ⊘ | USED, 40TH |
| (6) | ⊘ | ⊘ | ○ | USED, 50TH |
| (7) | ⊘ | ⊘ | ⊘ | USED, 60TH |
| (8) | ○ | ○ | ○ | UNUSED |

FIG. 7

21

| NUMBER OF USED COLOR BLOCKS | |
|---|---|
| 1 | ○○⊘ |
| 2 | ○○⊘ |
| ⋮ | ⋮ |
| 10 | ○⊘○ |
| 11 | ○○⊘ |
| ⋮ | ⋮ |
| 20 | ○⊘⊘ |
| 21 | ○○⊘ |

FIG. 8
| | | | |
|---|---|---|---|
| (1) | ○ | ⊘ | USED, 1ST~9TH |
| (2) | ⊘ | ○ | USED, 10TH |
| (3) | ⊘ | ⊘ | USED, OPTIONALLY SELECTED VALUE |
| (4) | ○ | ○ | UNUSED |
FIG. 9
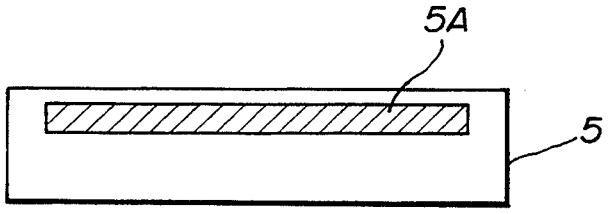
FIG. 10
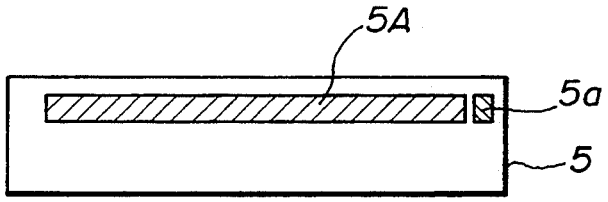

PRINTER AND INK RIBBON CARTRIDGE HAVING COLOR BLOCK DETECTION MEANS

BACKGROUND OF THE INVENTION

The present invention relates to a video printing apparatus and a ribbon cartridge usable in the apparatus.

A thermal ink ribbon for video printers is well known in the art. The ink ribbon includes an elongated substrate film and color layer formed on the substrate film. The color layer has a plurality of color blocks arranged in series. Each of the color blocks comprises segments arranged in a predetermined order, for example, yellow, magenta and cyan colors, respectively. One color block with segments is used for printing one sheet. A positioning mark is applied at a leading end of an initial one of the serial color blocks so as to indicate a start position of printing operation. Such an ink ribbon is wound up on a reel disposed in a cartridge case so as to be used as an ink ribbon cartridge. Two types of the ink ribbon cartridge are generally known, which are single-reel and double-reel types. The single-reel type cartridge has one reel for supply of the ink ribbon while the double-reel type cartridge has two reels used for supply and take-up of the ink ribbon, respectively.

However, since neither the video printer nor the ink ribbon cartridge has means for counting the number of the color blocks used for printing, a remaining volume of the ink ribbon can not be ascertained upon using the ink ribbon cartridge in a conventional video printer. In addition, ascertainment whether the ink ribbon is used or unused can be performed only by visual detection. Particularly, upon replacing the single-reel type cartridge with another one of the same type, the ink ribbon must be rewound up on the reel in the cartridge prior to removing the cartridge from the printer. Therefore, upon reusing the single-reel type cartridge, an unused part of the ink ribbon can not be readily found. Accordingly, in case that the ink ribbon cartridge is of such a single-reel type, the ink ribbon is undesirably wasted due to the undetection of an unused part of the ink ribbon upon use of the cartridge.

An object of the present invention is to provide a video printing apparatus capable of detecting used or unused state of color blocks of an ink ribbon and the number of used color blocks, so that the remaining volume of unused portions of the ink ribbon and a leading end of the unused portions are ascertained.

Another object of the present invention is to provide an ink ribbon cartridge for video printing apparatus, which serves for representing the number of used color blocks of an ink ribbon.

SUMMARY OF THE INVENTION

According to the present invention, there is provided a video printing apparatus including a thermal head and employing an ink ribbon cartridge in which an ink ribbon having a plurality of color blocks is accommodated, comprising means for addressing the color blocks when used in a printing operation, and sensor means for detecting the used color blocks. The addressing is performed by recording an identification mark on a predetermined portion of each of the used color blocks. The predetermined portion is unused in the printing operation. There is also provided an ink ribbon cartridge used in a video printing apparatus, comprising an ink ribbon accommodated in the cartridge. The ink ribbon has a plurality of color blocks and means for representing the number of the color blocks used in a printing operation. The representing means is provided on a predetermined portion of each of the used color blocks. The predetermined portion is unused in the printing operation.

BRIEF DESCRIPTION OF THE DRAWINGS

FIG. 6 is a diagram showing an example of the identification mark which is represented in the form of 3-bit patterns (1) to (8);

FIG. 7 is a diagram showing a relationship between the identification mark of FIG. 6 and the number of used color blocks provided on the ink ribbon indicated by the identification mark;

FIG. 8 is a diagram showing another example of the identification mark which is represented in the form of 2-bit patterns (1) to (4);

FIG. 9 is a schematic view of a printing region of a thermal head used in the apparatus; and FIG. 10 is a schematic view of an auxiliary head disposed adjacent the printing region of the thermal head of FIG. 9.

DESCRIPTION OF THE PREFERRED EMBODIMENT

Figure 1:
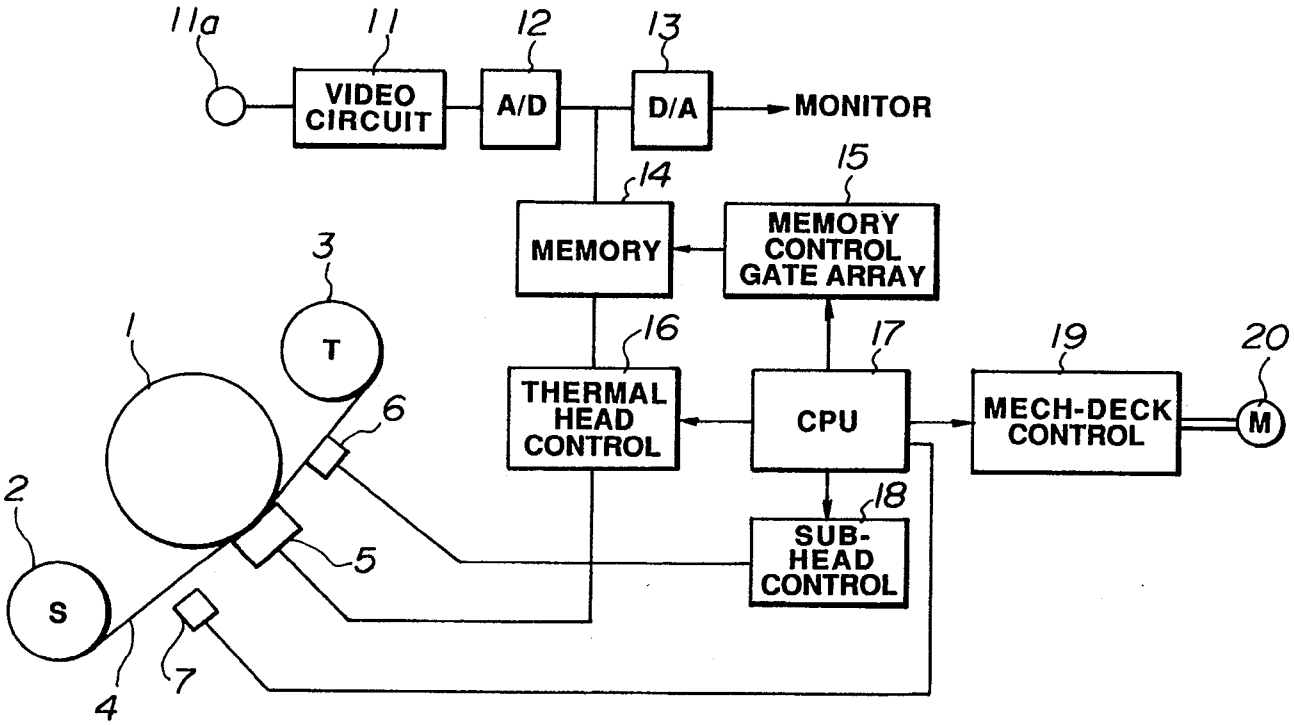
FIG. 1 is a block diagram of a preferred embodiment of a video printing apparatus according to the present invention.
Figure 2:
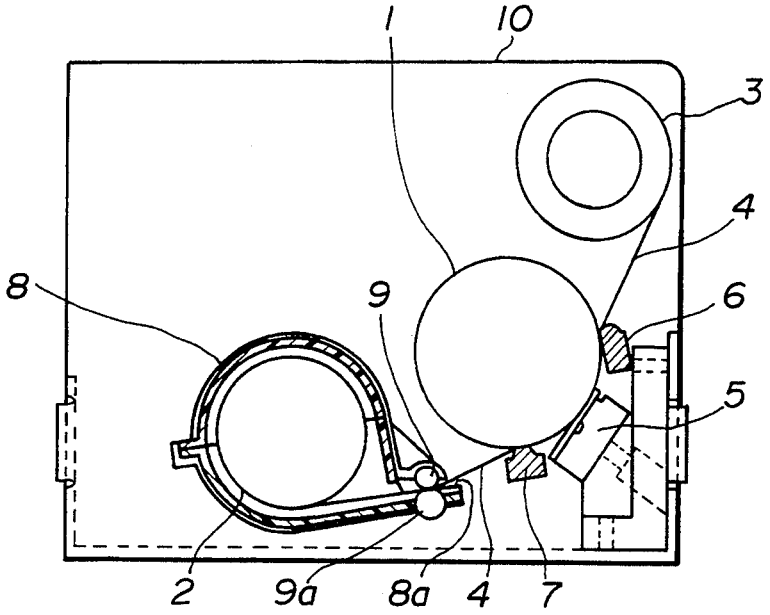
FIG. 2 is a schematic side view of the video printing apparatus.

Referring now to FIGS. 1 and 2, there are shown a block diagram and a schematic sectional view of a preferred embodiment of a video printing apparatus according to the present invention. As shown in FIG. 1, the video printing apparatus includes a supply (S) reel 2, a take-up (T) reel 3 and a platen roller 1 disposed between the supply and take-up reels 2 and 3. An ink ribbon 4 is connected at both ends thereof with the supply and take-up reels 2 and 3 and transported via the platen roller 1 from the supply reel 2 to the take-up reel 3 and vice versa. A thermal head 5 is arranged in opposed relationship to the platen roller 1 so as to urge the ink ribbon 4 against the platen roller 1 upon printing. Between the platen roller 1 and the ink ribbon 4 is supplied a recording sheet on which an image is printed. A subsidiary head 6 and a sensor 7 are disposed on both sides of the thermal head 5 and close to the take-up reel 3 and the supply reel 2 in opposed relationship to the ink ribbon 4. The subsidiary head 6 serves for recording an identification mark on the ink ribbon 4. The sensor 7 serves for detecting the identification mark recorded and a leading end of a fresh unused portion of the ink ribbon at which a subsequent printing operation starts.

FIG. 2 shows the video printing apparatus 10 in which a single-reel type of an ink ribbon cartridge 8 is employed. As shown in FIG. 2, the supply reel 2 is disposed in the ink ribbon cartridge 8. The ink ribbon 4 is derived from an outlet 8*a* of the ink ribbon cartridge 8 and then passes between a capstan roller 9 and a pinch roller 9*a*, via the platen roller 1 to the take-up reel 3. Feed of the ink ribbon 4 is controlled by rotation of the capstan roller 9.

As seen in FIG. 1, a video signal is transmitted from a terminal 11*a* to a video circuit 11 to be transferred to an A/D converter 12. The A/D converter 12 converts the detected analog signal into a digital signal which is transmitted to both a D/A converter 13 and a memory 14. The D/A converter 13 converts the digital signal into an analog signal for monitoring process. The memory 14 is connected via a memory control gate array 15 to a CPU 17. The memory 14 is controlled by the CPU so as to store the digital signal and read out the same for printing process. The read-out digital signal is transmitted to a thermal head control 16. The thermal head control 16 is controlled by the CPU 17 such that the thermal head 5 is driven to urge the ink ribbon 4 against the sheet placed on the platen roller 1. Motors 20 are connected to the CPU 17 via a mech-deck control 19. The motors 20 are controlled by the CPU 17 to drive the platen roller 1, the reels 2 and. 3 and the capstan roller 9 as shown in FIG. 2. A subsidiary head control 18 is also connected to the CPU 17 to thereby be controlled such that the subsidiary head 6 is driven to record an identification mark on the ink ribbon 4 during the printing process. The sensor 7 is also connected to the CPU 17 such that the sensor 7 detects the identification mark recorded on the ink ribbon 4.

Figure 3:
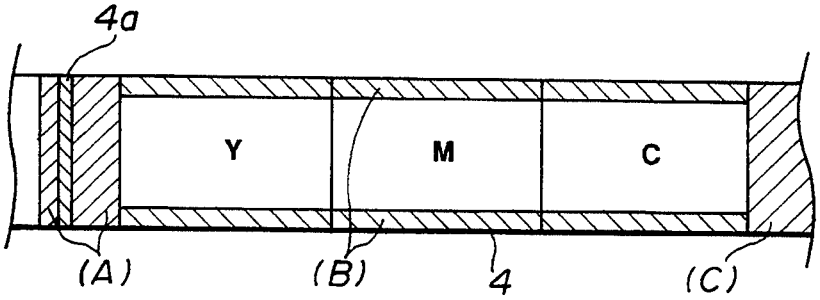
FIG. 3 is a schematic diagram showing a recording space which is defined on an ink ribbon for recording an identification mark.

As shown in FIG. 3, the ink ribbon 4 has a substrate film and a color layer formed on the substrate film. The color layer includes a plurality of color blocks one of which is disposed at a leading end of the ink ribbon 4 as shown in FIG. 3. Each of the color blocks has color segments arranged in a predetermined order, for example, yellow (Y), magenta (M) and cyan (C). A positioning mark 4*a* is disposed at a leading end of the initial color block, namely at a front end of the color segment Y. As the take-up and supply reels 2 and 3 start to rotate, the ink ribbon 4 moves toward the take-up reel 3 and then reaches the sensor 7. At this time, the positioning mark 4*a* is detected by the sensor 7. Due to the detection of the positioning mark 4*a*, a subsequent printing operation starts.

Defined around the color segments Y, M and C is a recording space for recording the identification mark which is recorded by the subsidiary head 6 and detected by the sensor 7. The recording space includes portions as indicated by (A), (B) and (C) in FIG. 3. Portion (A) is defined immediately adjacent a front end of the color segment Y and extends forward over the positioning mark 4*a*. Portion (B) is defined on both lateral sides of the color segments Y, M and C. Portion (C) is defined immediately adjacent a rear end of the color segment C. The identification mark is recorded on one portion of the recording space selected from the portions (A), (B) and (C).

The recording of the identification mark by the subsidiary head 6 is performed in such a manner as discoloring or decoloring by heat, application or deposition of a marking paint, and physically marking such as punching, recording by magnetic means or optical means such as ultraviolet, laser or the like.

Figure 4:
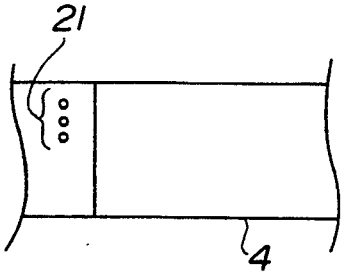
FIGS. 4 and 5 are schematic diagrams showing different arrangements of the identification mark on the ink ribbon.
Figure 5:
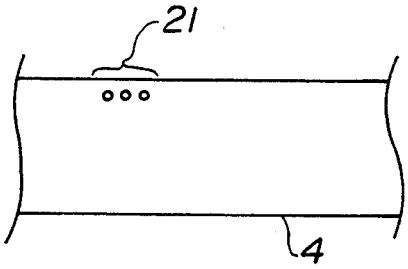

The identification mark 21 is recorded in a predetermined form selected from 1-bit, n-bit and bar code forms. The 1-bit form serves for only indicating used or unused state of the color block while the n-bit and bar code forms serve for providing informations about position or others. In this case, "n" indicated in the n-bit form represents the optionally selected number. As shown in FIGS. 4 and 5, the identification mark 21 of the n-bit or bar code form comprises bits having the same size which are recorded in array arranged in a substantially transverse or longitudinal direction of the ink ribbon 4. The subsidiary head 6 having an increased size is selected for the n-bit form while the subsidiary head 6 having a reduced size is selected for the bar code form. A timing for recording the identification mark 21 is controlled by the CPU 17 so as to be selected from (1) immediately prior to starting the printing operation, (2) immediately subsequent to terminating of the printing operation, and (3) during the printing operation.

One example of the identification mark 21 to be recorded on the ink ribbon will now be described hereinbelow, in which the identification mark 21 is represented in the form of 3-bit patterns (1) to (8) as shown in FIG. 6. In this case, the bit pattern (1) is employed to represent that individual first to ninth color blocks are already used in printing operation. When the first to ninth color blocks are used, the bit pattern (1) is recorded in the predetermined portion as indicated by (A), (B) or (C) in FIG. 3, of the recording space of each of the first to ninth color blocks. The bit patterns (2) to (7) are employed to represent every tenth color block used in printing. Namely, the bit patterns (2), (3) . . . (7) are recorded in the predetermined recording spaces of tenth, twentieth, thirtieth, fortieth, fiftieth and sixtieth color blocks, respectively. The blank bit pattern (8), which means no recording of the identification mark 21, is employed to represent that the first color block is unused, namely, the ink ribbon is unused.

As seen in FIG. 7, if eleventh to nineteenth color blocks are used, the bit pattern (1) is recorded in the recording space of each of them. Similarly, when twenty-first to twenty-ninth, thirty-first to thirty-ninth, forty-first to forty-ninth, fifty-first to fifty-ninth and sixty-first to sixty-ninth color blocks are used, the bit pattern (1) is recorded in the recording space of each of them. Thus, sixty-nine color blocks are addressed by the bit patterns (1) to (7) recorded thereon when used in printing. The bit patterns (2) to (7) representing every tenth color block used, serve as absolute values in an operation of detecting a specific color block by the sensor 7.

The detecting operation of the specific color block is performed by searching the identification mark 21 represented by the 3-bit pattern. For example, when the twenty-third color block is used, the identification mark 21 is recorded on the twenty-third color block while the number of the twenty-third color block is memorized by the CPU 17. At this time, if the printing operation stops due to an emergency POWER-OFF, the recording operation of the identification mark 21 stops. Simultaneously, the number of the used color blocks memorized by the CPU 17 prior to therefore stopping of the printing operation is cancelled. In order to restart the printing operation and the recording operation of the subsequent identification mark 21, the last used color block, namely, the twenty-third color block must be detected. Accordingly, the ink ribbon 4 is rewound on the supply reel 2 such that the absolute value last recorded on the color block is searched by the sensor 7. When the absolute value, namely the bit pattern (3), on the twentieth color block is searched, rewinding of the ink ribbon 4 stops and then the ink ribbon 4 moves in reverse to be wound on the take-up reel 3 such that the twenty-first to twenty-third color blocks are detected by the sensor 7. In the case of replacing an ink ribbon cartridge used at present with another one, an unused color block of an ink ribbon of the ink ribbon cartridge newly mounted in the printing apparatus is detected prior to restart of the printing operation in the same manner as at the emergency POWER-OFF.

Next, another example of the identification mark 21 recorded on the ink ribbon 4 will be described, in which the identification mark 21 is represented in the form of 2-bit patterns (1) to (4) as shown in FIG. 8. The bit pattern (1) is employed to represent that respective first to ninth color blocks are already used in printing. When the first to ninth color blocks are used, the bit pattern (1) is recorded in the predetermined recording space of each of the first to ninth color blocks. The bit patterns (2) and (3) are selectively employed to represent every tenth color block used in printing. The bit pattern (2) or (3) is recorded in the predetermined recording space of every tenth color block. The blank bit pattern (4), which means no record of the identification mark, is employed to represent that the first color block is unused, namely, the ink ribbon is unused. Similar to the 3-bit patterns, if first to ninth color blocks between respective tenth color blocks, i.e., eleventh to nineteenth, twenty-first to twenty-ninth and the like, are used, the bit pattern (1) is recorded in the recording space of each of the first to ninth color blocks. Upon an emergency POWER-OFF of the printing apparatus, the number of used color blocks and/or a remaining number of unused color blocks are ascertained by detecting the bit patterns (1) and (2) recorded on the used color blocks in the following manner. The ink ribbon 4 is rewound on the supply reel 2 until a first color block disposed at an initial end thereof is detected. Then, the ink ribbon 4 is wound again on the take-up reel 3, during which the bit patterns (1) and (2) recorded on the used color blocks are detected. As a result, the number of the used color blocks are ascertained and the last used color block is detected. When an ink ribbon cartridge is replaced with another one, an unused color block of an ink ribbon of the ink ribbon cartridge newly mounted in the printing apparatus is detected prior to restart of printing operation in the same manner as at the emergency POWER-OFF. Alternatively, while the bit pattern (2) is employed for marking a used state of every tenth color block, the bit pattern (3) is employed to represent the absolute value of a certain color block. For instance, the bit pattern (3) is marked on fiftieth color block, one-hundredth color block or the like. By employing the bit pattern (3) having such absolute value, upon the emergency POWER-OFF, it becomes unnecessary to rewind the ink ribbon up to the initial end thereof but it is sufficient to rewind the ink ribbon only up to the color block marked by the bit pattern (3).

The subsidiary head 6 may be omitted by using the thermal head 5 adapted for dual purposes of printing an image on the sheet and recording the identification mark on the ink ribbon. As shown in FIG. 9, the thermal head 5 has a printing region 5A which is used in both printing an image on the sheet and recording the identification mark on the ink ribbon. As shown in FIG. 10, an auxiliary head 5*a* may be disposed adjacent the printing region 5A of the thermal head 5 so as to serve for only recording the identification mark on the ink ribbon.

What is claimed is:

1. A video printing apparatus including a thermal head and an ink ribbon cartridge in which an ink ribbon having a plurality of color blocks is accommodated, comprising:

means for addressing the color blocks when used in a printing operation, said addressing means including means for recording identification marks on said ribbon indicative of used color blocks and of an absolute value of at least one of the used color blocks; and sensor means for detecting the used color blocks based on the presence of said identification marks and for ascertaining the absolute value of said at least one of the used color blocks;

wherein said addressing means provides means for recording said identification marks in 3-bit patterns on a predetermined portion of each of the used color blocks, said predetermined portion being unused in the printing operation.

2. A video printing apparatus as claimed in claim 1, wherein said addressing means is provided on the thermal head.

3. A method of ascertaining a number of used color blocks and/or a remaining number of unused color blocks of an ink ribbon cartridge in a video printer apparatus, comprising the steps of:

providing a video printer apparatus in which an ink ribbon having a plurality of color blocks is accommodated;

recording identification marks on said color blocks as said ink ribbon is used in a printing operation, said identification marks being indicative of: 1) prior use of said color blocks; and 2) an absolute value of at least one of said color blocks;

moving said ink ribbon in a reverse direction towards a closest one of said at least one color block having an identification mark indicative of an absolute value thereof;

detecting an absolute value of said closest one of said at least one color block based on said identification mark;

moving said ink ribbon in a forward direction towards a first unused color block; and detecting a number of used color blocks between said at least one color block and said first unused color block based on said identification marks indicative of prior use;.

wherein said step of recording identification marks comprises recording identification marks in 3-bit patterns on a predetermined portion of each of the used color blocks, said predetermined portion being unused in the printing operation.

4. A method of ascertaining a number of used color blocks and/or a remaining number of unused color blocks of an ink ribbon cartridge in a video printer apparatus, comprising the steps of:

providing a video printer apparatus in which an ink ribbon having a plurality of color blocks is accommodated:

recording identification marks on said color blocks as said ink ribbon is used in a printing operation, said identification marks being indicative of: 1) prior use of said color blocks; and 2) an absolute value of at least one of said color blocks;

moving said ink ribbon in a reverse direction towards closest one of said at least one color block having an identification mark indicative of an absolute value thereof;

detecting an absolute value of said closest one of said at least one color block based on said identification mark;

moving said ink ribbon in a forward direction towards a first unused color block; and detecting a number of used color blocks between said at least one color block and said first unused color block based on said identification marks indicative of prior use;

wherein said step of recording identification marks comprises recording identification marks in 2-bit patterns on a predetermined portion of each of the used color blocks, said predetermined portion being unused in the printing operation.

5. A video printing apparatus including a thermal head and an ink ribbon cartridge in which an ink ribbon having a plurality of color blocks is accommodated, comprising:

means for addressing the color blocks when used in a printing operation, said addressing means including means for recording identification marks on said ribbon indicative of used color blocks and of an absolute value of at least one of the used color blocks; and sensor means for detecting the used color blocks based on the presence of said identification marks and for ascertaining the absolute value of said at least one of the used color blocks;

wherein said addressing means provides means for recording said identification marks in 2-bit patterns on a predetermined portion of each of the used color blocks, said predetermined portion being unused in the printing operation.

6. A video printer apparatus for ascertaining a number of used color blocks and/or a remaining number of unused color blocks of an ink ribbon cartridge, comprising:

means for accommodating an ink ribbon having a plurality of color blocks;

means for recording identification marks on said color blocks as said ink ribbon is used in a printing operation, said identification marks being indicative of: 1) prior use of said color blocks; and 2) an absolute value of at least one of said color blocks;

means for moving said ink ribbon in a reverse direction towards a closest one of said at least one color block having an identification mark indicative of an absolute value thereof;

means for detecting an absolute value of said closest one of said at least one color block based on said identification mark;

means for moving said ink ribbon in a forward direction towards a first unused color block; and means for detecting a number of used color blocks between said at least one color block and said first unused color block based on said identification marks indicative of prior use;

said means for recording identification marks comprising means for recording identification marks in 3-bit patterns on a predetermined portion of each of the used color blocks, said predetermined portion being unused in the printing operation.

7. A video printer apparatus for ascertaining a number of used color blocks and/or a remaining number of unused color blocks of an ink ribbon cartridge, comprising:

means for accommodating an ink ribbon having a plurality of color blocks;

means for recording identification marks on said color blocks as said ink ribbon is used in a printing operation, said identification marks being indicative of: 1) prior use of said color blocks; and 2) an absolute value of at least one of said color blocks;

means for moving said ink ribbon in a reverse direction towards a closest one of said at least one color block having an identification mark indicative of an absolute value thereof;

means for detecting an absolute value of said closest one of said at least one color block based on said identification mark;

means for moving said ink ribbon in a forward direction towards a first unused color block; and means for detecting a number of used color blocks between said at least one color block and said first unused color block based on said identification marks indicative of prior use;

said means for recording identification marks comprising means for recording identification marks in 2-bit patterns on a predetermined portion of each of the used color blocks, said predetermined portion being unused in the printing operation.

* * * * *